US010905217B2

(12) United States Patent
Sanchez Martinez et al.

(10) Patent No.: US 10,905,217 B2
(45) Date of Patent: Feb. 2, 2021

(54) EPILATING DEVICE

(71) Applicant: Braun GmbH, Kronberg (DE)

(72) Inventors: Pedro Sanchez Martinez, Kronberg (DE); Andreas Brueckner, Veitshöchheim (DE)

(73) Assignee: Braun GMBH, Kronberg (DE)

( * ) Notice: Subject to any disclaimer, the term of this patent is extended or adjusted under 35 U.S.C. 154(b) by 150 days.

(21) Appl. No.: 16/007,416

(22) Filed: Jun. 13, 2018

(65) Prior Publication Data

US 2018/0360186 A1 Dec. 20, 2018

(30) Foreign Application Priority Data

Jun. 19, 2017 (EP) ..... 17176677

(51) Int. Cl.
*A45D 26/00* (2006.01)

(52) U.S. Cl.
CPC ..... *A45D 26/0038* (2013.01)

(58) Field of Classification Search
CPC ..... A45D 26/0028; A45D 26/0023; A45D 26/0066; A45D 26/0057; A45D 26/0076; A45D 26/0071; A45D 26/0052; A45D 26/0047; A45D 26/0042; A45D 26/0038; A45D 26/0033
See application file for complete search history.

(56) References Cited

U.S. PATENT DOCUMENTS

2018/0360186 A1 12/2018 Sanchez Martinez et al.

FOREIGN PATENT DOCUMENTS

| | | | |
|---|---|---|---|
| CN | 110785101 | A | 2/2020 |
| EP | 1289391 | B1 | 7/2005 |
| EP | 1673996 | A1 | 6/2006 |
| EP | 2280623 | B1 | 3/2012 |
| EP | 3417737 | A1 | 12/2018 |
| ES | 2764701 | T3 | 6/2020 |
| WO | 2014053765 | A1 | 4/2014 |
| WO | 2015150695 | A1 | 10/2015 |
| WO | 2018234998 | A1 | 12/2018 |

OTHER PUBLICATIONS

Ionescu, C.; Extended European Search Report and Written Opinion; European Application No. 17176677.7; dated Nov. 29, 2017; European Patent Office; Rijswijk, Netherlands.

Chatel, Cecile; International Preliminary Report on Patentability and Written Opinion of the International Searching Authority; International Application No. PCT/IB2018/054512; dated Dec. 24, 2019; European Patent Office; Rijswijk, Netherlands.

Ionescu, C; International Search Report and Written Opinion of the International Searching Authority; International Application No. PCT/IB2018/054512; dated Dec. 27, 2018; European Patent Office; Rijswijk, Netherlands.

Decision to Grant Under Article 97(1); European Patent Application No. 17176677.7; dated Sep. 19, 2019; European Patent Office; Munich, Germany.

*Primary Examiner* — Anh T Dang
(74) *Attorney, Agent, or Firm* — Kevin C. Johnson

(57) ABSTRACT

An epilating device having a frame, a pair of clamping elements with a first clamp and a second clamp mounted in the frame, wherein each clamp has a skin contact surface facing towards the user's skin. The first clamp and the second clamp being inclined with respect to each other in the open position and being parallel to each other in the closed position.

15 Claims, 2 Drawing Sheets

EPILATING DEVICE

FIELD OF THE INVENTION

The present invention is concerned with an electronically operated hair removing device, in more detail with an epilating device for removing and or plucking hairs from a user's skin.

BACKGROUND OF THE INVENTION

Epilating devices often comprise a drum rotating during operation and having several pairs of clamps provided on the drum for plucking hairs from a user's skin. EP 2 280 623 B1 discloses an epilating device having a flexible base on which the clamps are mounted such that bending of the base results in opening and closing the clamps. During this bending, the clamps pivot about an axis which is substantially parallel to the user's skin.

EP 1 289 391 B1 and EP 1 673 996 A1 disclose further drum type epilating devices for plucking the hair from a user's skin by means of two clamps, like a pair of tweezers, wherein one of the clamps is fixed to a frame whereas the other of the clamps is coupled to a displaceable lever such that displacement of the lever opens and closes the pair of clamps with one of the clamps performing a pivoting movement about an axis which is substantially parallel to the user's skin. In other words, the clamps are in a V-shaped inclined orientation with respect to each other in their open position defining a space facing towards the user's skin for gripping a user's hair and the clamps are in a substantially parallel orientation, i.e. substantially perpendicular to the user's skin, with respect to each other in their closed clamping position.

The orientation of the respective pairs of clamps or tweezers resulting in opening and closing substantially in the radial direction of the drum requires a relatively large space of the drum for accommodating the clamps and the actuation mechanism for driving the clamps. In addition, depending on the location and arrangement of the actuation mechanism, opening and closing the clamps in the radial direction of the drum may have drawbacks regarding the transmission of forces for clamping a user's hair. Further, with the clamps opening and closing in the radial direction it is difficult to guide individual hairs between the open clamps.

It is an object of the present disclosure to provide an improved hair removing device overcoming the above-mentioned drawbacks and restrictions of the known epilating devices.

SUMMARY OF THE INVENTION

In accordance with one aspect of the present disclosure an electrically operable hair removing device, in particular an epilating device for removing hairs from a user's skin, may comprise at least one frame, at least one pair of clamping elements with a first clamp and a second clamp mounted in the frame, wherein each clamp has a skin contact surface facing towards the user's skin during operation of the device. The second clamp may be mounted in the frame pivotable about a first pivoting axis and relative to the first clamp between an open position and a closed clamping position, with the first clamp and the second clamp being inclined with respect to each other in the open position and being at least substantially parallel to each other in the closed position. Especially with one or more hairs clamped or gripped between a pair of clamps when in use, the clamps may have an orientation in the closed clamping position which is not fully parallel to each other, but rather defines an acute angle between the clamps. The device may further comprise at least one displaceable lever mounted in the frame and coupled to the second clamp for pivoting the second clamp relative to the first clamp between the open position and the closed clamping position, and an electrically driven actuation mechanism for driving the displaceable lever with respect to the frame. According to the present disclosure, the first pivoting axis extends perpendicular to the skin contact surfaces of the clamps. If the clamping elements are arranged on a drum rotating during operation of the device, the first pivoting axis preferably extends radially with respect to the axis of rotation of the drum.

With this orientation of the pivoting axis of the second clamp, the pair of clamps is in a V-shaped orientation with respect to each other as seen from the user's skin when in the open position and the pair of clamps has a reduced opening angle or the clamps are parallel to each other as seen from the user's skin when in the closed clamping position. In other words, the pair of clams opens and closes substantially in a circumferential direction when mounted on a drum.

The orientation of the clamps with the first pivoting axis extending perpendicular to the skin contact surfaces has the benefit that the clamps substantially extend in parallel to the skin contact surfaces, thereby reducing the axial space required for arranging the clamps. In addition, a clamping force may be transmitted in a more efficient way, thereby improving the hair removing result. Further, the orientation of the clamps facilitates guiding the hairs in the V-shaped space formed between the clamps in their open position.

Further details and features of the invention may be obtained from the following description of embodiments in conjunction with the drawings.

DETAILED DESCRIPTION OF THE INVENTION

Figure 1A:
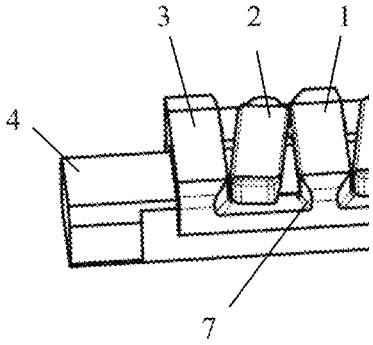
FIG. 1*a* shows in a schematic side view a portion of an embodiment of a device according to the invention in the open position.

In the epilating device the skin contact surfaces of the first clamp and the second clamp are preferably parallel to each other, e.g. in the same plane, both in the open position and in the closed position. In contrast to the known epilating devices opening and closing the pairs of clamps substantially in a radial direction, the skin contact surfaces of the respective clamps remain during operation generally in the plane of the user's skin which may contribute in less skin irritations.

According to an embodiment of the epilating device, the first clamp may be fixed to the frame. The first clamp may be permanently fixed to the frame such that relative movement between the first clamp and the frame is prevented. For example, the first clamp may be an integral part of the frame. In this embodiment opening and closing the pair of clamps or tweezers is effected by pivoting only the second clamp with respect to the fixed first clamp. This reduces the effort for driving both clams relative to each other. Thus, the design of this embodiment is relatively simple and cost-effective.

In a further embodiment of the epilating device, the first clamp may be mounted in the frame pivotable about a third pivoting axis and relative to the second clamp between an open position and a closed clamping position, with the first clamp and the second clamp being inclined with respect to each other in the open position and being parallel to each other in the closed position. In this further embodiment both clamps are pivoting between the open position and the closed clamping position.

The second clamp may be coupled to the displaceable lever pivotable about a second pivoting axis. In other words, a pure linear movement of the displaceable lever, e.g. parallel to the skin contact surfaces, may be translated into a pivoting movement of the second clamp about the first pivoting axis which is preferably parallel and offset to the second pivoting axis.

In more detail, the second clamp may comprise a first pin and a second pin located at a side of the second clamp opposite the skin contact surface. The first pin is preferably pivotably mounted in the frame and defines the first pivoting axis. Further, the second pin may be pivotably mounted in the displaceable lever and defines the second pivoting axis. With this configuration, the second clamp may be designed as a bar having a flat skin contact surface on one side and the two pins protruding from the side facing away from the skin contact surface. While it is preferred that the first pin defining the first pivoting axis is provided at a first end of the second clamp, the position of the second pin with respect to an opposite second end defining the second pivoting axis coupled to the displaceable lever may vary, thereby adapting the actuation of the second clamp between larger pivoting speed (second pin offset from the second end) and larger clamping force (second pin closer to the second end).

While it is generally possible to provide an epilating device with only one single pair of clamps, it is preferred that several pairs of clamping elements, i.e. clamps or tweezers, are mounted to one frame to increase hair removing effectivity. The respective first pivoting axes of the several pairs of clamps are preferably parallel to each other and perpendicular to the skin contact surfaces. The design of the drive mechanism fur pivoting the pairs of clamps may be a simple and reliable by coupling the second clamps of the several pairs of clamps to the same displaceable lever.

According to a further embodiment of the present disclosure, the frame may be provided on a drum or may be a unitary component of a drum, wherein the drum is electrically driven rotatable about a rotation axis extending parallel to the skin contact surfaces. As an alternative to the provision of several frames on a drum, the frames may be provided on a belt. Both alternatives allow providing several frames with several pairs of clamps even with limited construction space in small hair removing devices. In other words, in the epilating device the drum may comprise several frames each comprising several pairs of clamping elements.

The hair removing result may be increased by providing the pairs of clamping elements of one of the several frames offset in a direction parallel to the rotation axis with respect to the pairs of clamping elements of an adjacent frame. For example, when provided on the drum, the pairs of clamping elements may be offset in increments of less than the width of the pair of clamping elements in the direction of the rotation axis. The size of the increments may be chosen depending on the number of frames on the drum such that after one full revolution of the drum the pairs of clamping elements are offset by about the width of one pair of clamping elements.

In the epilating device the electrically driven actuation mechanism may comprise an electric motor, at least one cam plate and a gear mechanism for moving the displaceable lever relative to the cam plate. For example, the cam plate may be designed and arranged with respect to the displaceable lever such that the lever is displaced, e.g. in a direction parallel to the rotation axis of the drum, when abutting the cam of the cam plate. This movement of the displaceable lever caused by the interaction with the cam plate may result in pivoting the second clamp from the open position into the closed clamping position. As an alternative to the provision of the cam plate the displaceable lever may be guided with a sliding block in a guide track, thereby causing actuation of the displaceable lever depending on its relative position with respect to the guide track. The provision of a sliding block and the guide track may not only be used for moving the second clamp into the closed clamping position but may also be used for moving the second clamp back into the open position.

According to an embodiment, the epilating device may further comprise at least one first elastically deformable element, for example a compression spring, wherein the elastically deformable element biases the displaceable lever into the open position of the clamps. Thus, without a driving force acting on the displaceable lever, the lever is shifted into the position in which the pairs of clamping elements are in their open position, i.e. in a V-shaped orientation as seen from the user's skin. The pairs of clamping elements may for example be moved to the closed clamping position only for the relatively short period of time for gripping and clamping the hairs for removal. As an alternative or in addition to the provision of a spring or the like elastically deformable element biasing the clamping elements in their open position, two cam plates may be used for actuating the lever in opposite directions, i.e. for moving the second clamp into the open position and in the closed clamping position, respectively.

The cam plate of the epilating device may be rotationally fixed to a support comprising bearings for the rotation axis of the drum. The support may be part of or coupled to the housing of the epilating device or may be part of or coupled to an, e.g. removable, head of the epilating device. Further, at least one second elastically deformable element may be provided biasing the cam plate axially parallel to the rotation axis in abutment with the at least one displaceable lever and/or the drum. Thus, the clamping force transmitted by the displaceable lever to the second clamp is provided by the second elastically deformable element, e.g. a spring, acting on the cam plate. If a compression spring or the like is provided as of the first elastically deformable element for biasing the displaceable lever into the open position of the second clamp, the spring force of the second elastically deformable element has to be chosen to be larger than the spring force of the first elastically deformable element. The provision of the second elastically deformable element has the benefit that this spring may compensate different closed clamping positions of the second clamp depending for example from the size and/or the position of the hair gripped by a pair of clamping elements.

The second elastically deformable element may be a yoke spring, for example arranged such that one end of the yoke spring directly or indirectly acts on the drum while the other end acts directly or indirectly on the cam plate. As an alternative, the second elastically deformable element may be a compression spring arranged between the cam plate and a support structure, thereby biasing the cam plate towards the drum and the levers.

The orientation of the clamping elements opening substantially in a circumferential direction of the drum or the like has the benefit of guiding hairs into the V-shaped space between the clamping elements. This effect may be further increased by providing at least one of the first clamp and the second clamp comprising a substantially rectangular skin contact surface with a tapering at the end facing away from the first pivoting axis. In other words, the end facing away from the first pivoting axis may have a V-shaped guiding area even in the closed position of the clamping elements. In addition or as an alternative, one or both clamping elements may be flattened in direction of movement of drum.

Figure 1B:
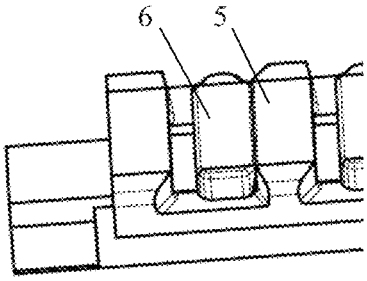
FIG. 1*b* shows in a schematic side view a portion of the device of FIG. 1*a* in the closed clamping position.

In the embodiment depicted in FIGS. 1*a* and 1*b*, a single pair of clamping elements is depicted in the open state or position (FIG. 1*a*) and in the closed clamping state or position (FIG. 1*b*), respectively. The pair of clamping elements comprises a first clamp 1 and a second clamp 2. The first clamp 1 is provided as a portion of a frame 3. The second clamp 2 is movable with respect to the frame 3 and the first clamp 1. For actuation of the second clamp 2 a displaceable lever 4 is provided which may be guided in the frame 3 as depicted in FIGS. 1*a* and 1*b*.

Figure 2:
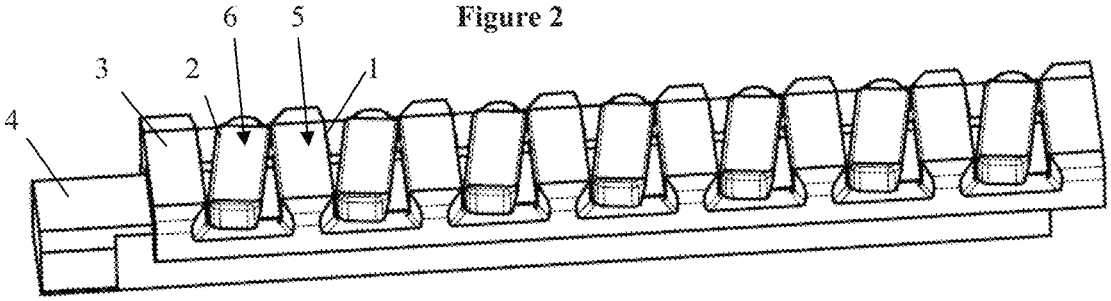
FIG. 2 shows in a schematic side view a larger portion of the device of FIG. 1*a* in the open position.

FIGS. 1*a* and 1*b* are enlarged details of FIG. 2 which depicts that the frame 3 may comprise several first clamps 1 and that the displaceable lever 4 is coupled to several second clamps 2, thereby forming several pairs of clamping elements which may be opened and closed simultaneously.

Each of the first clamps 1 and each of the second clamps 2 comprises a skin contact surface 5, 6 which is substantially flat in the depicted embodiment. In use of the epilating device the skin contact surfaces 5, 6 face towards the user's skin. The first clamps 1 and the second clamps 2 have a substantially rectangular skin contact surface 5, 6. The first clamps 1 may be provided with a tapering 7 for guiding hairs into the V-shaped space between the first clamp 1 and the second clamp 2 in the open position (FIG. 1*a*).

Figure 3:
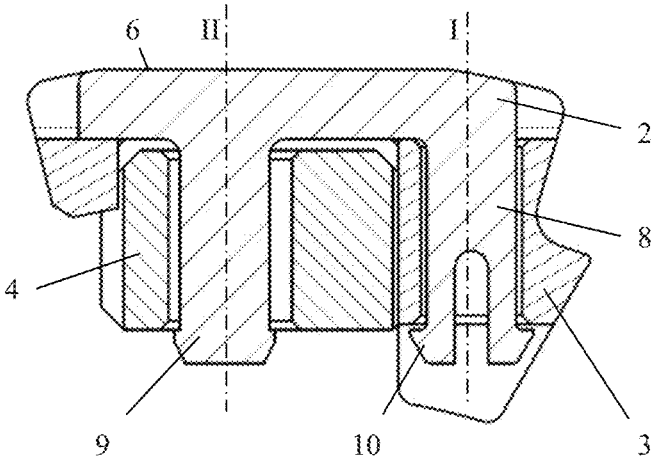
FIG. 3 shows in a sectional view a portion of the device of FIG. 1*a*.

FIG. 3 shows in a sectional view that each of the second clamps 2 is provided with two pins 8, 9 defining a first pivoting axis I and a second pivoting axis II which are parallel to each other and perpendicular to the skin contact surface 6. The pins 8, 9 are provided on the side opposite to the skin contact surface 6 and faces away from the skin contact surface 6. The frame 3 is provided with an opening for receiving the first pin 8 such that the second clamp 2 is rotatable (pivotable) about the first pin 8 and the first pivoting axis I. Snap elements 10 a may be provided at the free end of the first pin 8 such that the first pin 8 is axially constrained to the frame 3. The second pin 9 is received in a respective opening of the displaceable lever 4 such that the second clamp 2 is rotatable (pivotable) about the second pin 9 and the second pivoting axis II. With this configuration the second clamp 2 is movable in a pivoting manner from its open position as shown in FIGS. 1*a* and 2 to its closed clamping position shown in FIG. 1*b* by an axial displacement of the lever 4 with respect to the frame 3 to the right as seen in FIG. 2. Further, the second clamp 2 is movable in a pivoting manner from its closed clamping position shown in FIG. 1*b* to its open position as shown in FIGS. 1*a* and 2 by an axial displacement of the lever 4 with respect to the frame 3 to the left as seen in FIG. 2.

Figure 4:
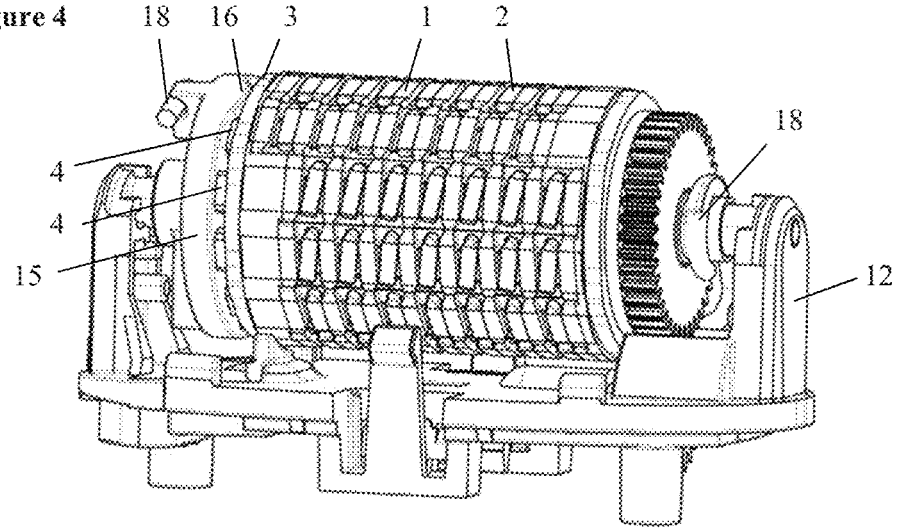
FIG. 4 shows in a schematic view a head of an epilating device with several portions according to FIG. 2.
Figure 5C:
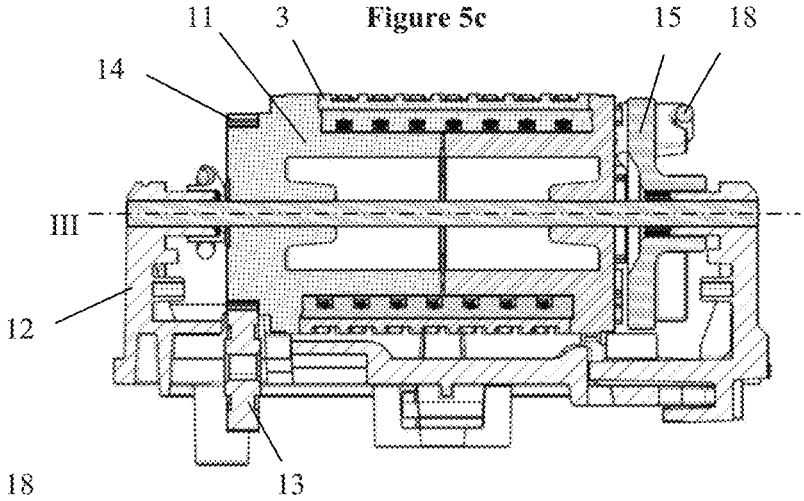
FIG. 5*c* shows a sectional view along line C-C in FIG. 5*a*.
Figure 5A:
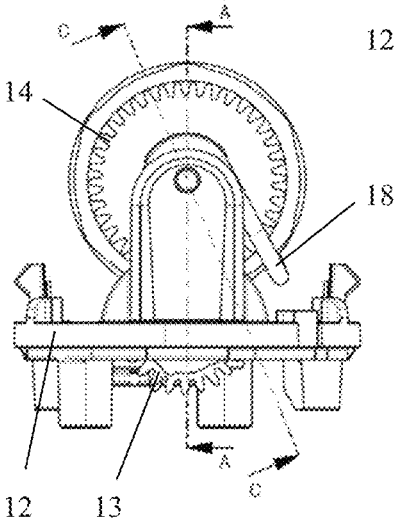
FIG. 5*a* shows a side view of the head of FIG. 4.

While FIGS. 1*a* to 2 depict only a single frame 3 or a portion thereof, FIGS. 4 to 5*c* depict further components of an, e.g. removable, head of an epilating device with several frames 3 each comprising several pairs of clamping elements arranged on a drum 11. The head is provided with the support structure 12 comprising bearings for a shaft defining a rotation axis III about which the drum 11 is rotatable. The drum 11 may be rotated by means of an electric motor (not shown) interacting in use with a gear mechanism comprising a pinion 13 meshing with a gear wheel 14 of the drum 11. In other words, in use of the epilating device the drum 11 with the several frames 3 and the respective pairs of clamping elements all rotate about rotation axis III with respect to the support structure 12. The frames 3 and the levers 4 are arranged parallel to the rotation axis III in the drum 11. The frames 3 guiding the respective levers 4 are depicted as individual component parts inserted into drum 11 in the embodiment shown in FIGS. 4 to 5*c*. However, as an alternative, the frames 3 may be provided as an integral portion of the drum 11.

Figure 5B:
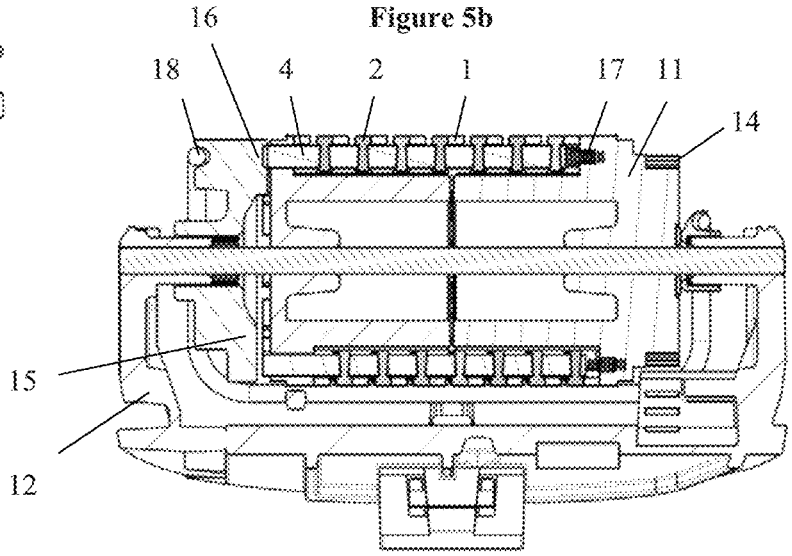
FIG. 5*b* shows a sectional view along line A-A in FIG. 5*a*.

A cam plate 15 is provided on the left side of the drum 11 as seen in FIGS. 4 and 5*b*. The cam plate 15 is rotationally constrained to the support structure 12 such that the drum 11 rotates relative to the cam plate 15 in use of the device. The cam plate 15 is provided with at least one cam 16 protruding towards the drum 11. The cam 16 is arranged such that when the drum 11 rotates the levers 4 subsequently abut the cam 16 and are thereby shifted relative to the drum 11 and the cam plate 15 which causes actuation of the second clamps 2 coupled to the respective lever 4 for pivoting of the second clamps 2 into the closed clamping position. In other words, during rotation of the drum 11 relative to the cam plate 15 the pairs of clamping elements of a lever 4 and a frame 3 are automatically closed due to the interaction of the lever 4 with the cam 16 of the cam plate 15 every time the respective lever 4 passes over the cam 16.

On the side facing away from the cam plate 15 a compression spring 17 is provided in the drum 11 for each of the levers 4. The compression springs 17 are arranged such that each spring biases one of the levers 4 towards the cam plate 15, i.e. in a direction for opening the pairs of clamping elements. Thus, the pairs of clamping elements are automatically moved into their open position by a compression spring 17 when the respective lever 4 loses contact with the cam 16 of the cam plate 15.

The epilating device further comprises a yoke spring 18 arranged at or the head for biasing the cam plate 15 towards the drum 11 with the levers 4. Due to the yoke spring 18 pressing the cam plate 15 with the cam 16 towards the drum 11 and to the levers 4, the yoke spring 18 provides the clamping force for closing the pairs of clamping elements and for gripping hairs between the first clamp 1 and the second clamp 2. The force exerted by the yoke spring 18 exceeds the force provided by the compression spring 17 such that the levers 4 are axially displaced parallel to the rotation axis III against the bias of the compression spring 17 when the respective lever 4 comes in contact with the cam 16 of the cam plate 15.

In addition to providing the clamping force, the yoke spring 18 compensates variations in the orientation of the second clamp 2 with respect to the first clamp 1 in the closed clamping position. In other words, with a hair clamped between the first clamp 1 and the second clamp 2, it is possible that the second clamp 2 does not fully reach its parallel orientation with respect to the first clamp 1. This deviation from the parallel orientation depends on the size of the hair gripped between the clamps and depends on the position at which the hair is gripped between the clamps.

As can be seen in particular from FIG. 4, the epilating device according to the present disclosure has a simple structure not requiring a large construction space for providing multiple frames 3 and levers 4 even on the relatively small drum 11. This is based on the orientation of the first pivoting axis I defined by the first pin 8 of the second clamp 2 perpendicular to the rotation axis III and extending in the radial direction of the drum 11. This orientation has the additional benefit of the first clamp 1 and the second clamp 2 forming a V-shaped space in their open position facing in the direction of rotation of the drum 11, thereby guiding the hairs on a user's skin in the V-shaped space.

The interaction of levers 4 with the cam 16 can be seen in FIG. 4, in which in the two upper lines the pairs of clamping elements 1, 2 are substantially parallel to each other, i.e. in their closed clamped position, due to the abutment of the upper levers 4 with the cam 16. In contrast to that, in the lower lines of pairs of clamping elements 1, 2, there is no interaction of the respective levers 4 with cam 16, such that the respective springs 17 push the levers back into the open position. Thus, in the lower lines the clamps 1, 2 are inclined to each other, thereby forming a V-shaped opening space for receiving hairs during rotation of drum 11.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An epilating device for removing hairs from a user's skin, the device comprising:

at least one frame, at least one pair of clamping elements with a first clamp and a second clamp mounted in the frame, wherein each clamp has a skin contact surface facing towards the user's skin, at least one displaceable lever mounted in the frame and coupled to the second clamp for pivoting the second clamp relative to the first clamp between an open position and a closed clamping position, and an electrically driven actuation mechanism for driving the displaceable lever with respect to the frame, wherein the second clamp is mounted in the frame pivotable about a first pivoting axis and relative to the first clamp between the open position and the closed clamping position, with the first clamp and the second clamp being inclined with respect to each other in the open position and being parallel to each other in the closed position, wherein the first pivoting axis extends perpendicular to the skin contact surfaces.

2. The epilating device in accordance with claim 1, wherein the skin contact surfaces of the first clamp and the second clamp are in the same plane in the open position and in the closed position.

3. The epilating device in accordance with claim 1, wherein the first clamp is fixed to the frame.

4. The epilating device in accordance with claim 1, wherein the first clamp is mounted in the frame pivotable about a third pivoting axis and relative to the second clamp between an open position and a closed clamping position, with the first clamp and the second clamp being inclined with respect to each other in the open position and being parallel to each other in the closed position.

5. The epilating device in accordance with claim 1, wherein the second clamp is coupled to the displaceable lever pivotable about a second pivoting axis.

6. The epilating device in accordance with claim 5, wherein the second clamp comprises a first pin and a second pin located at a side of the second clamp opposite the skin contact surface, wherein the first pin is pivotably mounted in the frame and defines the first pivoting axis, and wherein the second pin is pivotably mounted in the displaceable lever and defines the second pivoting axis.

7. The epilating device in accordance with claim 1, wherein several pairs of clamping elements are mounted to one frame, wherein the first pivoting axes of the several pairs of clamping elements are parallel to each other and perpendicular to the skin contact surfaces.

8. The epilating device in accordance with claim 7, wherein the second clamps of the several pairs of clamping elements are coupled to the displaceable lever.

9. The epilating device in accordance with claim 1, wherein the frame is provided on a drum or is a unitary component of a drum, wherein the drum is electrically driven rotatable about a rotation axis extending parallel to the skin contact surfaces.

10. The epilating device in accordance with claim 9, wherein the drum comprises several frames each comprising a lever and several pairs of clamping elements.

11. The epilating device in accordance with claim 10, wherein the pairs of clamping elements of one of the several frames are offset in a direction parallel to the rotation axis with respect to the pairs of clamping elements of an adjacent frame.

12. The epilating device in accordance with claim 9, wherein the electrically driven actuation mechanism comprises an electric motor, at least one cam plate and a gear mechanism for moving the displaceable lever relative to the cam plate.

13. The epilating device in accordance with claim 12, wherein the cam plate is rotationally fixed to a support comprising bearings for the rotation axis of the drum, wherein at least one second elastically deformable element is provided biasing the cam plate axially parallel to the rotation axis in abutment with the at least one displaceable lever and the drum.

14. The epilating device in accordance with claim 1 further comprising at least one first elastically deformable element, wherein the elastically deformable element biases the displaceable lever into the open position of the clamps.

15. The epilating device in accordance with claim 1, wherein at least one of the first clamp and the second clamp comprises a substantially rectangular skin contact surface with the end facing away from the first pivoting axis having a tapering.

* * * * *